US010731433B2

(12) United States Patent
Liew

(10) Patent No.: US 10,731,433 B2
(45) Date of Patent: Aug. 4, 2020

(54) SYSTEM AND METHOD FOR EXPANDABLE LANDING LOCKING SHOULDER

(71) Applicant: GE Oil & Gas Pressure Control LP, Houston, TX (US)

(72) Inventor: Joseph Shu Yian Liew, Singapore (SG)

(73) Assignee: GE Oil & Gas Pressure Control LP, Houston, TX (US)

( * ) Notice: Subject to any disclaimer, the term of this patent is extended or adjusted under 35 U.S.C. 154(b) by 149 days.

(21) Appl. No.: 15/960,036

(22) Filed: Apr. 23, 2018

(65) Prior Publication Data

US 2019/0323313 A1 Oct. 24, 2019

(51) Int. Cl.
*E21B 33/04* (2006.01)
*E21B 23/01* (2006.01)

(52) U.S. Cl.
CPC ..... *E21B 33/04* (2013.01); *E21B 23/01* (2013.01)

(58) Field of Classification Search
CPC ..... E21B 33/04; E21B 23/01
See application file for complete search history.

(56) References Cited

U.S. PATENT DOCUMENTS 4,276,932 A 7/1981 Saliger et al.
4,691,780 A 9/1987 Galle, Jr.
4,730,851 A 3/1988 Watts
8,127,853 B2 3/2012 Pallini
8,833,461 B2 9/2014 Varghese et al.
9,689,225 B2 * 6/2017 Harsono ..... E21B 33/035
9,835,003 B2 * 12/2017 Harris ..... E21B 23/01
10,018,008 B2 * 7/2018 Cain ..... E21B 33/04
2008/0135261 A1 6/2008 McGilvray
2010/0243238 A1 9/2010 Gette
2011/0253389 A1 10/2011 Nguyen
2012/0025470 A1 2/2012 Gette
2012/0241175 A1 9/2012 Galle
2015/0114668 A1 4/2015 Mansukh
2016/0032674 A1 2/2016 Nguyen
2017/0114605 A1 4/2017 Gadre

OTHER PUBLICATIONS

International Search Report and Written Opinion dated Jul. 17, 2019 in corresponding PCT Application No. PCT/US2019/028463.
Dril-Quip, "SS-15 Big Bore II-H Subsea Wellhead System," 2014, 28 pages.

* cited by examiner

*Primary Examiner* — David J Bagnell
*Assistant Examiner* — Jonathan Malikasim
(74) *Attorney, Agent, or Firm* — Hogan Lovells US LLP

(57) ABSTRACT

Embodiments of the present disclosure include a system for suspending a hanger within a wellbore component including an actuation ring circumferentially positioned about the hanger. The system also includes an arm removably coupled to the actuation ring, the arm extending longitudinally from the actuation ring and including a head at an end opposite the actuation ring. The system further includes a landing profile formed on the head on an outer diameter of the head, the landing profile including a plurality of landing features forming a plurality of landing shoulders. The system includes a tag shoulder formed on the actuation ring, the tag shoulder arranged to contact a protrusion within the wellbore component to drive upward axial movement of the actuation ring along an axis, the upward axial movement being transferred to the arm to move the arm toward an activated position.

20 Claims, 8 Drawing Sheets

SYSTEM AND METHOD FOR EXPANDABLE LANDING LOCKING SHOULDER

BACKGROUND

1. Field of the Invention

The present disclosure relates in general to downhole wellbore operations and more particularly to hanging devices for use with downhole and drilling systems.

2. Description of Related Art

During downhole drilling and recovery operations, various tools may be tripped into and out of a wellbore to perform a number of different tasks. For example, a wellhead or subsea tree may receive a hanger, such as a casing hanger, to suspend a wellbore tubular into the wellbore. Often, these hangers are secured within the respective locations via load rings or the like. Due to the environments in which the casing hangers are used, the load rings are formed from high strength, corrosive resistant materials, and as a result, may be expensive. Furthermore, misalignment of the load rings, for example during installation or due to wellbore upsets, may dislodge the hangers and/or the wellbore tubulars, which may then fall into the wellbore, halting operations until a fishing tool may retrieve the tool or another outcome is accepted, such as drilling through the fallen tubular, which may damage the drill bit.

SUMMARY

Applicants recognized the problems noted above herein and conceived and developed embodiments of systems and methods, according to the present disclosure, for wellbore hanging systems.

In an embodiment a system for supporting a wellbore tubular within a wellbore includes a wellbore component associated with the wellbore, the wellbore component including an axial bore arranged along an axis. The system also includes a hanger installed within the wellbore component to support the wellbore tubular, the hanger including a shoulder that receives the wellbore tubular and suspends the wellbore tubular along the axis. The system further includes an expandable landing locking shoulder arranged circumferentially about the hanger. The expandable landing locking shoulder includes an actuation ring removably coupled to a body of the hanger, the actuation ring including a shoulder and extension, the extension extending longitudinally in an upward direction from the shoulder. The expandable landing locking shoulder also includes a body portion coupled to the actuation ring, the body portion including coupling members that mate with corresponding coupling members of the actuation ring. The expandable landing locking shoulder further includes arms extending in the upward direction from the body portion, the arms including a head with a landing profile that engage a recess formed in the wellbore component when in an activated position.

In another embodiment, a system for suspending a hanger within a wellbore component includes an actuation ring circumferentially positioned about the hanger, the actuation ring having a substantially annular shape. The system also includes an arm removably coupled to the actuation ring, the arm extending longitudinally from the actuation ring and including a head at an end opposite the actuation ring. The system further includes a landing profile formed on the head on an outer diameter of the head, the landing profile including a plurality of landing features forming a plurality of landing shoulders. The system includes a tag shoulder formed on the actuation ring, the tag shoulder arranged to contact a protrusion within the wellbore component to drive upward axial movement of the actuation ring along an axis, the upward axial movement being transferred to the arm to move the arm toward an activated position.

In an embodiment, a method for installing a hanger within a wellbore component includes coupling an expandable landing locking shoulder to a mandrel hanger, the expandable landing locking shoulder circumferentially surrounding the mandrel hanger. The method further includes determining if an outer diameter of the mandrel hanger is greater than an outer diameter of the expandable landing locking shoulder. The method also includes installing the mandrel hanger within the wellbore component when the outer diameter of the mandrel hanger is greater than the outer diameter of the expandable landing locking shoulder.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

Figure 1:
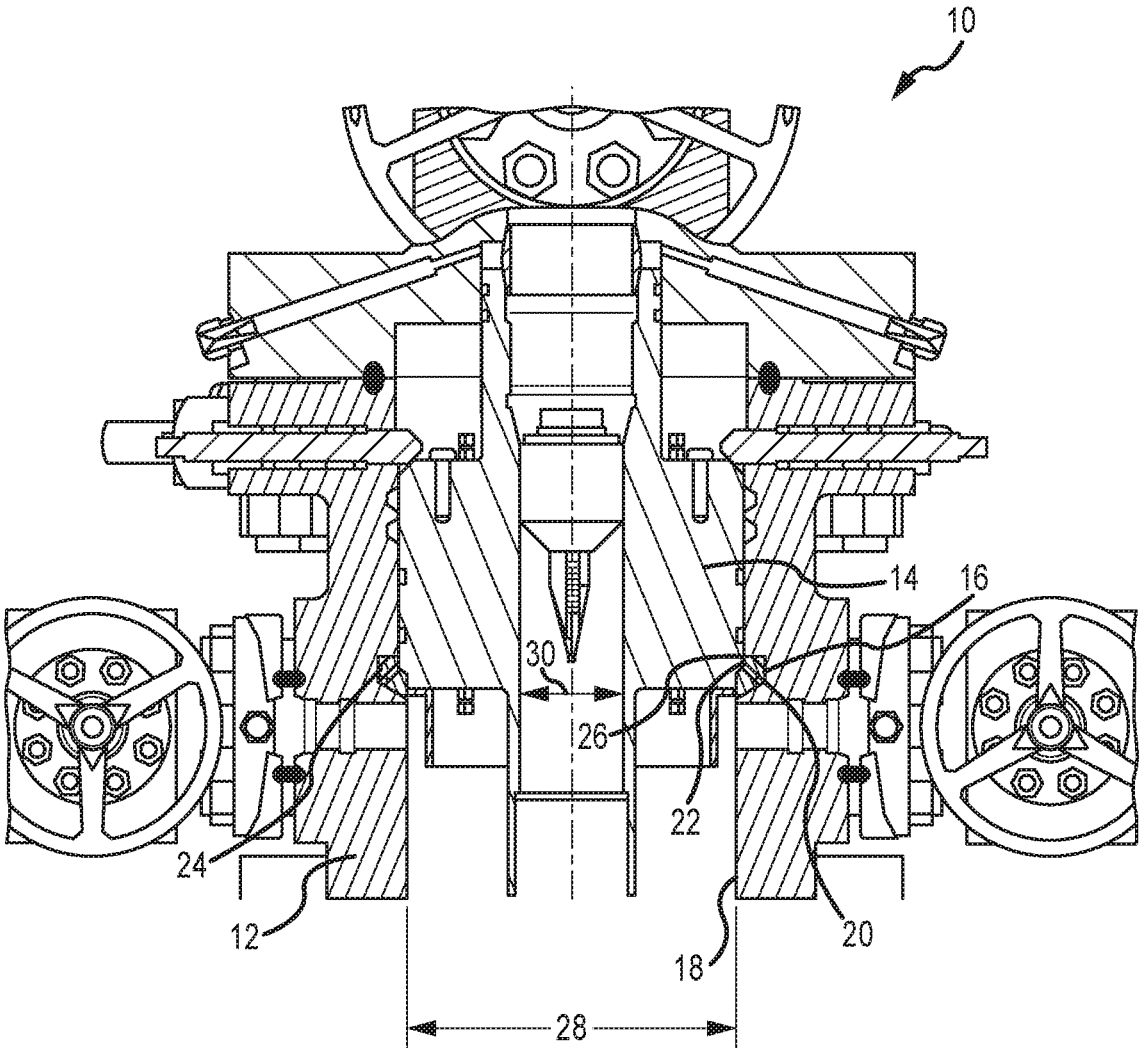
FIG.1 (PRIOR ART)
FIG. 1 is a schematic cross-sectional side view of an embodiment of a hanging system.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Embodiments of the present disclosure include systems and methods for installing hanging systems within a wellbore. In various embodiments, the hanging systems may be deployed without utilizing expensive and often difficult to install load rings, thereby decreasing the cost and complexity associated with installation of the hanging systems. For example, in various embodiments, a mandrel-style casing or tubing hanger includes an expandable landing locking shoulder that includes arms that may be driven radially outward to engage a wellbore component, such as a wellhead. These arms may further include a landing profile that engages a recess formed within the wellbore component. In various embodiments, the landing profile includes a plurality of landing shoulders, which may engage the recess and thereby support the hanger within the wellbore component. As a result, the load ring may be eliminated from the system and installation of the system may be simplified. Embodiments of the present disclosure may arrange the expandable landing locking shoulder such that an outer diameter is less than an outer diameter of the mandrel casing hanger. Accordingly, the hanger may be installed within wellbores having approximately the same outer diameter as the casing hanger, as the expandable landing locking shoulder will not interfere with installation. In this manner, longer sections of wellbore tubulars, such as casings, may be installed by utilizing systems and methods of the present disclosure. Additionally, in various embodiments, the expandable landing locking shoulder may include voids arranged between the arms. The voids may be open spaces that enable flow by during installation procedures, thereby allowing circulating and cleaning within the wellbore during installation. Embodiments of the present disclosure may enable using less costly materials to perform wellbore operations, thereby decreasing costs to producers.

FIG. 1 is a schematic cross-sectional side view of an embodiment of a wellbore system 10 including a wellhead 12 supporting a casing hanger 14 via a load ring 16. The illustrated wellhead 12 includes an axial bore 18 into which the casing hanger 14 is lowered, for example via a running tool. The illustrated load ring 16 supports the casing hanger 14 within the wellhead 12 to block axial movement of the casing hanger 14 in at least one direction, for example downward into the wellbore. It should be appreciated that various aspects of the wellbore system 10 have been removed for clarity and conciseness and that, in various embodiments, additional features such as tubing heads, tubing hangers, Christmas trees, and the like may further be incorporated into the wellbore system 10. Furthermore, embodiments of the present disclosure may be referred to with reference to the casing hanger 14, however, it should be appreciated that systems and methods of the present disclosure may be used with a variety of mandrel-type hangers utilized in downhole operations.

The illustrated load ring 16 includes a body portion 20 and a pin 22. For example, the illustrated body portion 20 may include an expandable ring wherein the pin 22 drives the body portion 20 outward into a notch 24 formed in the wellhead 12. The load ring 16 forms a shoulder 26 to suspend the casing hanger 14. It should be appreciated that while the illustrated load ring 16 includes the body portion 20 and the pin 22, various other configurations may be utilized. As described above, in various embodiments the load ring 16 is formed from high strength or non-corrosive materials, such as metals with high nickel content. These materials may be expensive, often prohibitively so, and therefore increase the costs associated with wellbore operations. Furthermore, in various embodiments, alignment of the load ring 16 within the notch 24 may be challenging for skilled operators, which increases the time to conduct wellbore operations. Additionally, misalignment may lead to the casing hanger 14 unseating, which may lead to loss of tools, tubulars, and/or lost productive time on the wellbore. For example, the load ring 16 and/or hanger may fall into the wellbore, which may lead to costly and time consuming retrieval operations or drilling through the components, which is wasteful and also may damage drill bits.

During installation, the load ring 16 may be installed within the notch 24 and the casing hanger 14 is lowered into the wellhead 12 until it contacts the load ring 16. Thereafter, a wellbore tubular may be suspended from the casing hanger 14. As illustrated in the embodiment shown in FIG. 1, a bore diameter 28 is greater than a casing hanger bore diameter 30. Accordingly, an outer diameter of the wellbore tubular will be limited by the casing hanger bore diameter 30. This may present a bottleneck in production, such as by limiting the amount of casing that may be installed within the wellbore and also reducing flow rates through the wellbore. As will be described below, systems and methods of the present disclosure are utilized to enable larger wellbore tubulars and also eliminate the load ring 16, thereby providing a more cost effective hanger system and also enabling larger flow rates and more flexibility within the wellbore.

Figure 2:
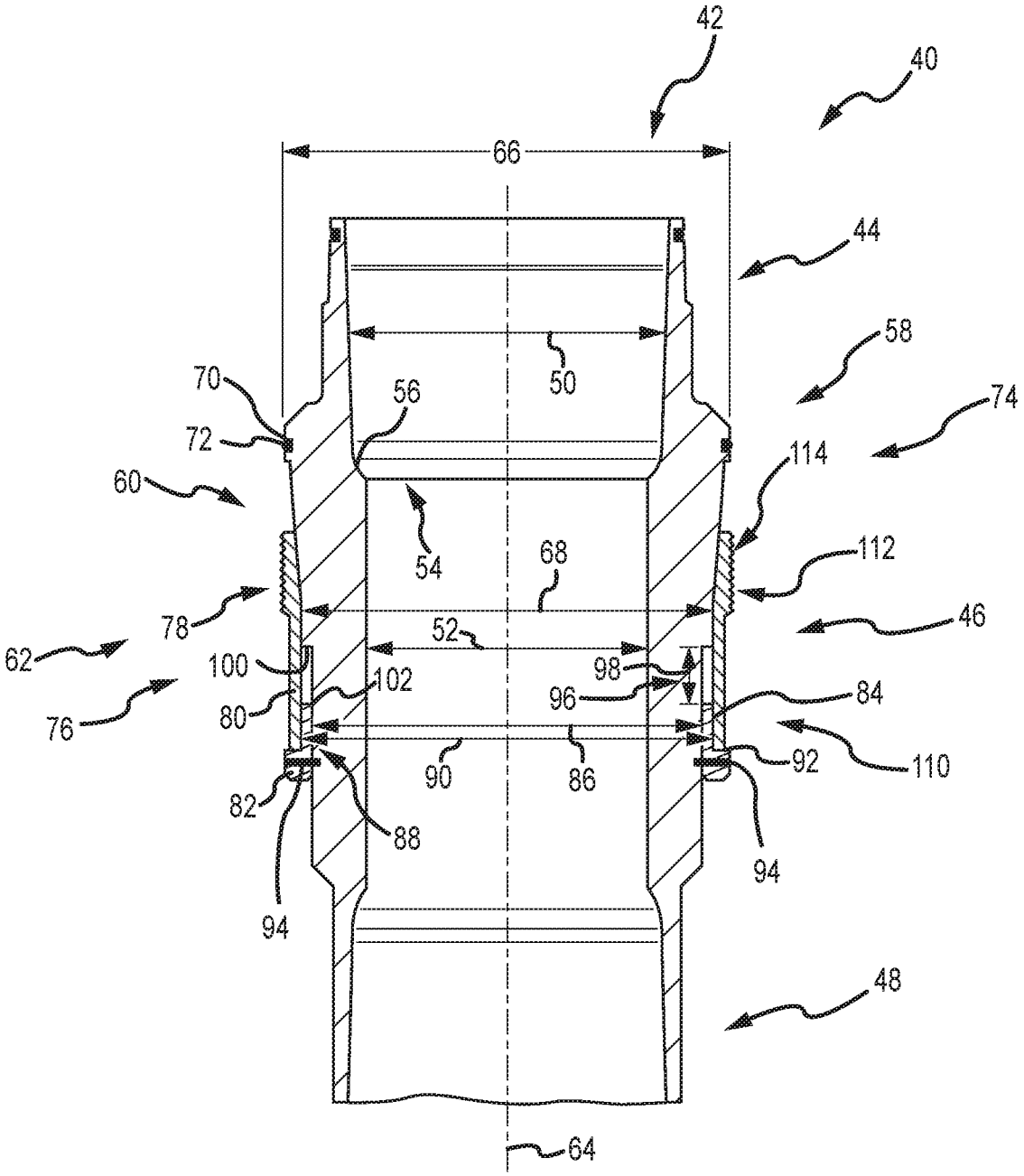
FIG. 2 is a schematic cross-sectional side view of an embodiment of a mandrel casing hanger having an expandable landing locking shoulder, in accordance with embodiments of the present disclosure.

FIG. 2 is a schematic cross-sectional side view of an embodiment of a mandrel casing hanger 40. In various embodiments, the mandrel casing hanger 40 may be tripped into a wellbore, for example via a running tool, and positioned at a predetermined, desired location. For example, the mandrel casing hanger 40 may include one or more threaded connections to facilitate coupling to the running tool. The illustrated mandrel casing hanger 40 includes a bore 42 that includes a first bore portion 44, a second bore portion 46, and a third bore portion 48. The illustrated first bore portion 44 has a larger diameter 50 than a diameter 52 of the second bore portion 46. A transition 54 between the first bore portion 44 and the second bore portion 46 forms a shoulder or hanger 56, which may be utilized to receive a wellbore tubular for suspension into the wellbore.

Figure 7:
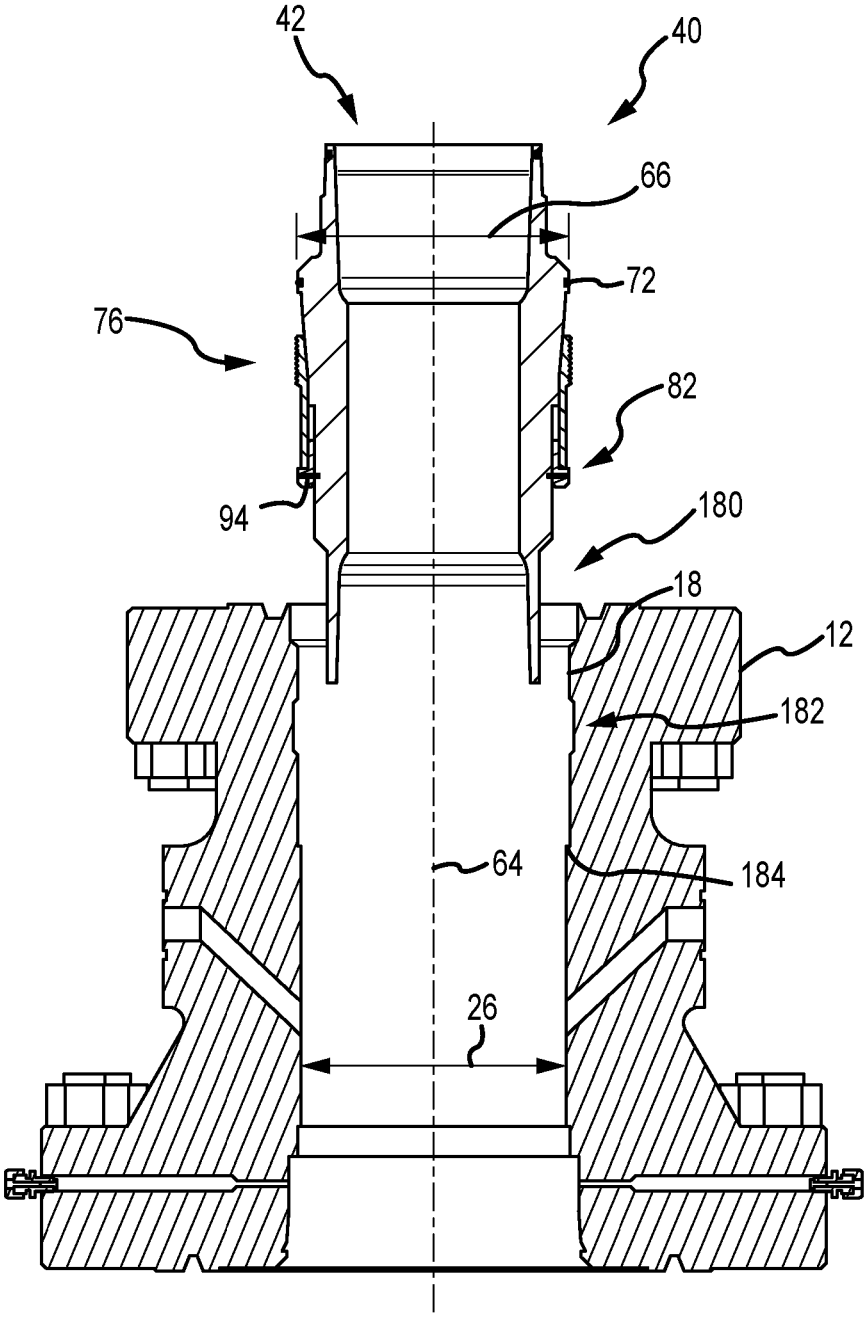
FIG. 7 is a schematic cross-sectional view of an embodiment of a mandrel casing hanger positioned over a wellhead, in accordance with embodiments of the present disclosure.
Figure 8:
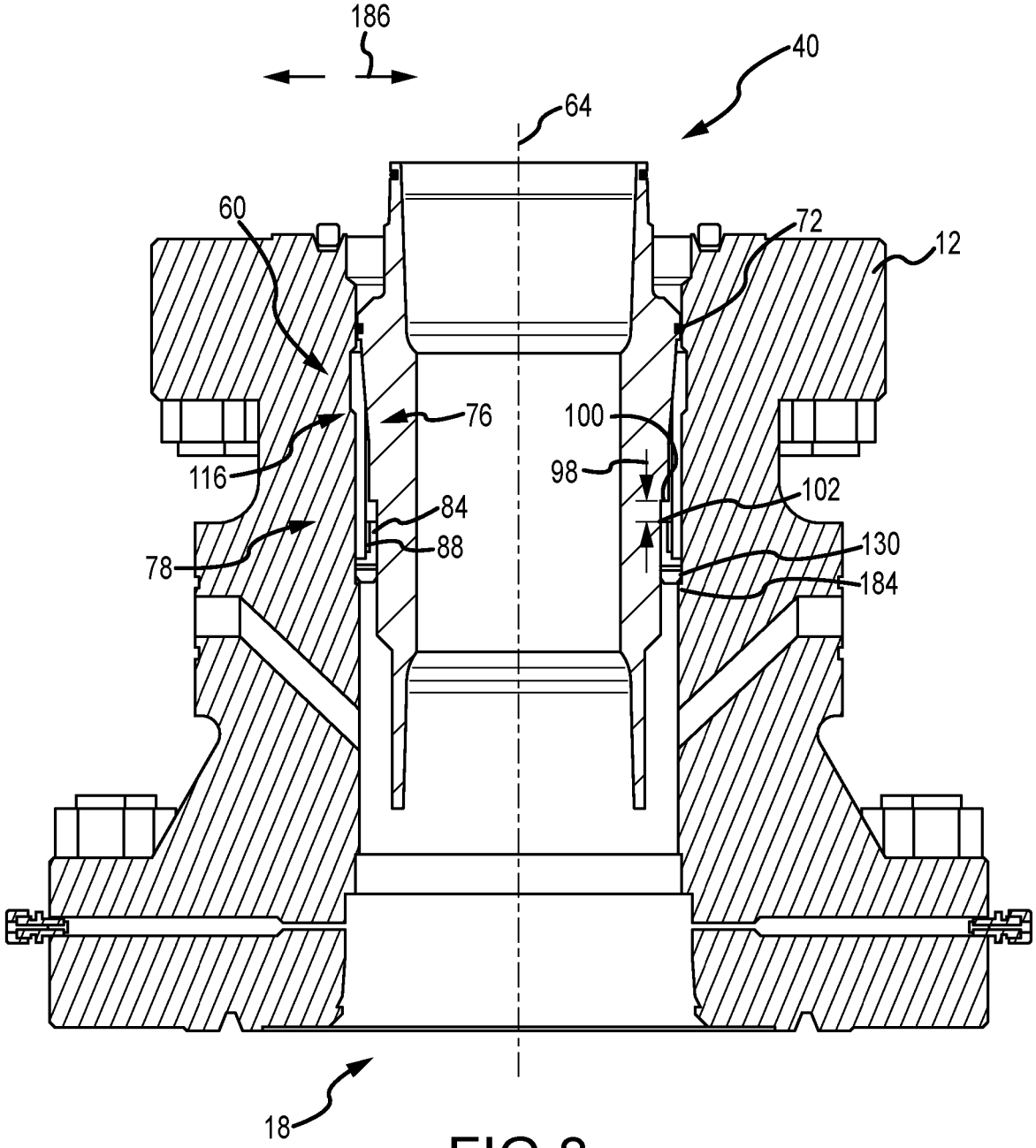
FIG. 8 is a schematic cross-sectional view of an embodiment of a mandrel casing hanger partially installed within a wellhead, in accordance with embodiments of the present disclosure.
Figure 9:
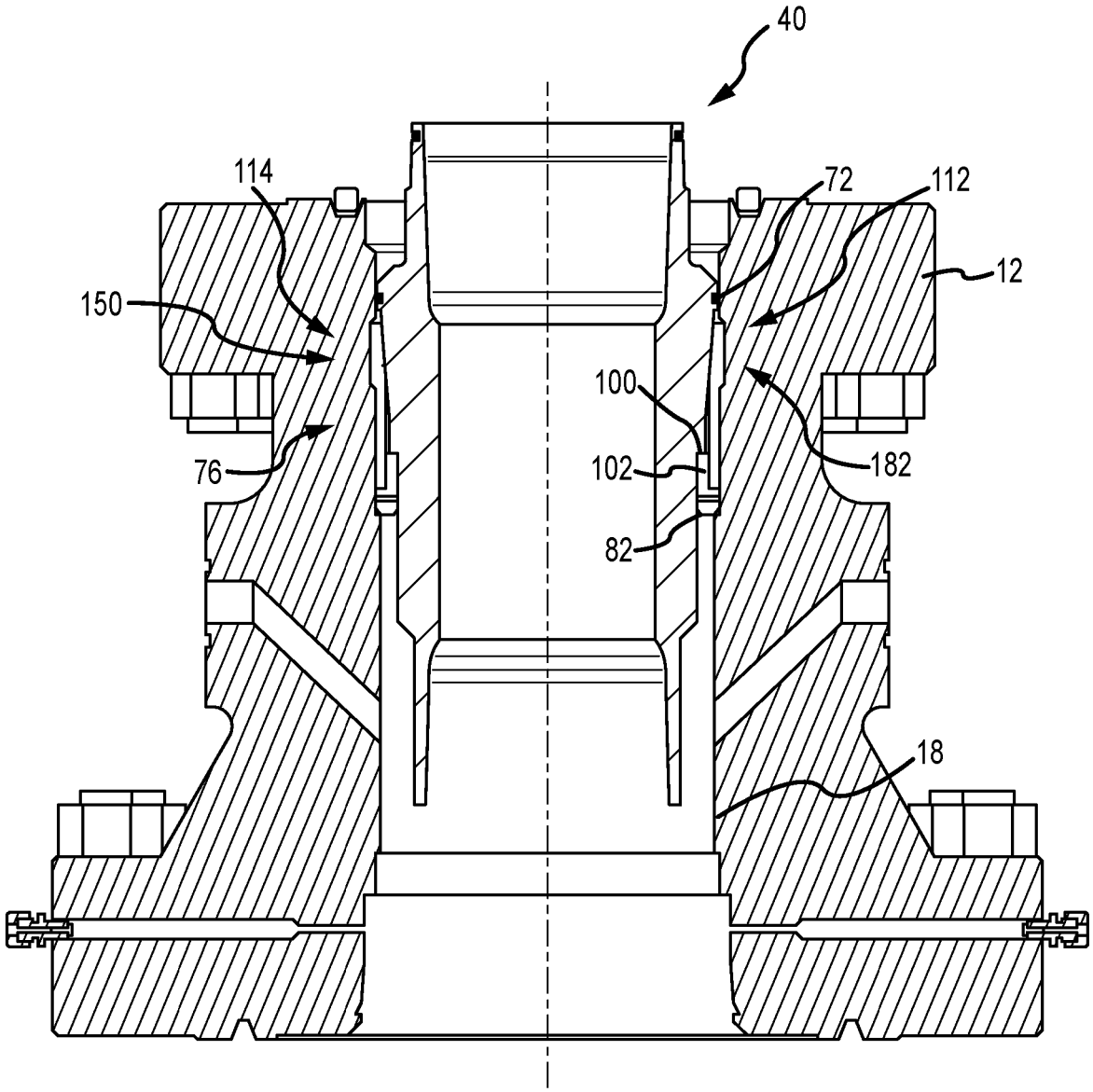
FIG. 9 is a schematic cross-sectional view of an embodiment of a mandrel casing hanger installed within a wellhead, in accordance with embodiments of the present disclosure.

In the embodiment illustrated in FIG. 2, the mandrel casing hanger 40 includes a hanger body 58 that includes a tapered shoulder 60. The illustrated tapered shoulder 60 includes a variable diameter 62 which slopes inwardly toward an axis 64 of the mandrel casing hanger 40. In other words, an outer diameter 66 at a top of the tapered shoulder 60 is larger than an outer diameter 68 at a bottom of the tapered shoulder 60. As will be described below, the tapered shoulder 60 may be utilized to activate one or more locking members to secure the mandrel casing hanger 40 within the wellbore and/or wellhead 12. In various embodiments, the tapered shoulder 60 facilitates alignment and centralization of the mandrel casing hanger 40 with the axial bore 18, as illustrated in FIGS. 7-9.

In various embodiments, the hanger body 58 includes a groove 70 that receives a seal 72 that circumferentially surrounds an upper portion 74 of the mandrel casing hanger 40. As will be described below, once the mandrel casing hanger 40 is set the seal 72 may block fluid flow upward through the wellhead 12.

The illustrated embodiment further includes an expandable landing locking shoulder 76 arranged about the outer diameter of the mandrel casing hanger 40. In the illustrated embodiment, the expandable landing locking shoulder 76 includes arms 78 that flex radially outward upon activation. In various embodiments, the expandable landing locking shoulder 76 includes a body portion 80 from which the arms 78 extend. The body portion 80 is coupled to an actuation ring 82, which circumferentially surrounds the mandrel casing hanger 40. It should be appreciated that in the illustrated embodiment the expandable landing locking shoulder 76 is arranged proximate the second portion 46 of the mandrel casing hanger 40. As will be described below, in operation, the actuation ring 82 is utilized to drive the arms 78 and/or body portion 80 upward along the tapered shoulder 60, thereby driving the arms 78 radially outward to engage the wellhead 12 and/or another predetermined wellbore component.

In various embodiments, the body portion 80 includes coupling members 84 along an inner diameter 86, such as the illustrated threads. The coupling members 84 mate with corresponding members 88 on an outer diameter 90 of the actuation ring 82. It should be appreciated that while the illustrated embodiment includes threads, that in other embodiments different coupling members such as bolts, screws, rivets, adhesives, dogs, clamps, and the like may be utilized to couple the body portion 80 to the actuation ring 82. In the illustrated embodiment, the actuation ring 82 includes a shelf 92. The shelf 92 may receive and hold the body portion 80 in a predetermined position. However, it should be appreciated that, in various embodiments, the shelf 92 may be excluded because the force between the respective coupling members 84, 88 is sufficient to secure the body portion 80 to the actuation ring 82.

As shown in FIG. 2, the actuation ring 82 is secured to the mandrel casing hanger 40 via shear pins 94 arranged circumferentially around the actuation ring 82. It should be appreciated that any number of shear pins 94 may be utilized to secure the actuation ring 82 to the mandrel casing hanger 40. In various embodiments, the actuation ring 82, and as a result the body portion 80 and the arms 78, are arranged at a particularly selected predetermined position to reduce an overall outer diameter of the system, thereby facilitating installation within a bore having a diameter approximately equal to the outer diameter 66 at the seal 72. In other words, the actuation ring 82 may be arranged to enable a lower-profile design of the mandrel casing hanger 40. As a result, the mandrel casing hanger 40 may be installed within larger bores, which further enables larger bored casing to be hung in the bore, which even further enables more sections of casing to be installed. As will be described below, in operation the actuation ring 82 may contact a shoulder of the wellhead 12 to drive upward movement of the actuation ring 82 along the axis 64, which in turn drives the arms 78 radially outward.

In various embodiments, axial movement of the arms 78 and/or the body portion 80 along the axis 64 is particularly selected based on the position of the actuation ring 82. That is, a gap 96 having a distance 98 may be selected based on operating conditions and the desired outward radial movement of the arms 78. In various embodiments, the distance 98 may be particularly selected for each application as a function of the bore diameter 28 and further upward movement of the arms 78 will be blocked via contact between a stop shoulder 100 arranged on the mandrel casing hanger 40 and an extension 102 of the actuation ring 82. Factors such as the material forming at least one component of the expandable landing locking shoulder 76 may at least partially determine the distance 98. For example, outward radial movement of the arms 78 may be desirable over a particular range of the material, which may be known as the elastic range and may be defined as the Modulus of Elasticity of a material, such that the arms 78 return to their previous position after use, thereby enabling the mandrel casing hanger 40 and/or the expandable landing locking shoulder 76 to be reused in other applications. Examples of such materials and values include carbon and low alloy steels (approximately 200 GPa or 29 E6 psi), stainless steels (approximately 193 GPa or 28 E6 psi), copper (approximately 117 GPa to 17 E6 psi), iron (approximately 210 GPa or 28.5 E6 psi), molybdenum (approximately 329 GPa or 40 E6 psi). It should be appreciated that combinations of these materials, and other materials, may be utilized and would have different values. Accordingly, the distance 98 may be particularly selected to maintain the arms 78 within the elastic range of the material utilize to form the arms 78 and/or other components of the expandable landing locking shoulder 76. In various embodiments, one or more components of the expandable landing locking shoulder 76 may be formed from a variety of materials, such as metals, plastics, composite materials, or a combination thereof.

In the illustrated embodiment, the arms 78 include a longitudinal section 110 and a landing profile 112. As shown, the longitudinal section 110 extends upwardly along the axis 64. The landing profile 112 is coupled to the longitudinal section 110 and includes a plurality of landing features 114. In various embodiments, the landing features 114 may be wickers, notches, cut outs, a helical sweep, or the like that mate with the wellhead 12 and/or wellbore component to secure the mandrel casing hanger 40. As will be described below, the landing features 114 may provide improved distribution of the load handled by the landing profile 112 because of the plurality of shoulders to grip the corresponding wellhead 12 and/or wellbore components.

Figure 3:
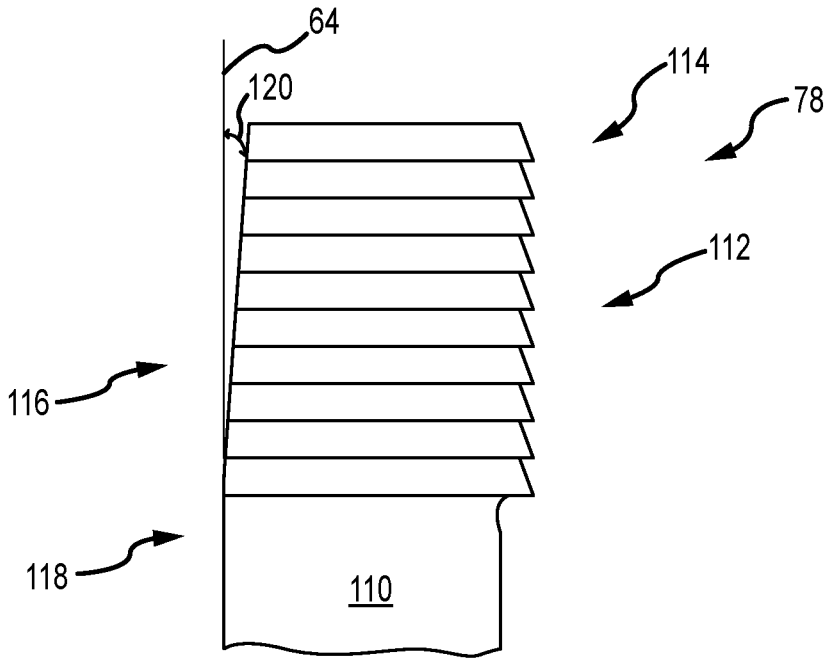
FIG. 3 is a partial detailed side view of an embodiment of a landing profile of an expandable landing locking shoulder, in accordance with embodiments of the present disclosure.

FIG. 3 is a detailed side elevational view of an embodiment of the landing profile 112 illustrating the plurality of landing features 114. In the illustrated embodiment, the landing profile 112 is arranged on a head 116 on an end 118 of the longitudinal section 110. The illustrated head 116 is arranged at an angle 120 relative to the axis 64. However, it should be appreciated that, in various embodiments, the angle 120 may be approximately 0 degrees and the head 116 may be substantially aligned with the axis 64. The angle 120 may be particularly selected based on design conditions, as described above, in order to reduce the outward radial deflection of the arms 78 to bring the landing profile 112 into contact with the wellhead 12 and/or the wellbore component. That is, a larger angle 120 may reduce outward radial deflection of the arms 78 while a smaller angle may increase the outward radial deflection of the arms 78. Furthermore, the angle 120 may position the landing profile 112 at an angle in contact with the wellhead 12, thereby distributing the forces along the angle and reducing the stresses on the landing profile 112. In the illustrated embodiment, the angle 120 is substantially equal to the angled formed by the tapered shoulder 60 such that the expandable landing locking shoulder 76 fits against the mandrel casing hanger 40. Such an arrangement facilitates a reduced outer diameter, thereby enabling installation within a wide variety of bores.

As described above, in various embodiments the landing features 114 forming the landing profile 112 are comprised of concentric grooves which may be referred to as wickers. However, it should be appreciated that other landing profiles 112 having different landing features 114 may also be utilized to secure the mandrel casing hanger 40 the wellhead 12. As shown in FIG. 3, the landing profile 112 is radially outward from the longitudinal section 110. As such, the landing profile 112 may contact the wellhead 112 with less radial deflection of the longitudinal section 110, as described above, which may reduce the stress on the arms 78 and maintain the arms 78 within the elastic region of the specified material. Accordingly, the arms 78 may return to their original position after removal from the wellbore, thereby facilitating reuse in other applications.

Figure 4:
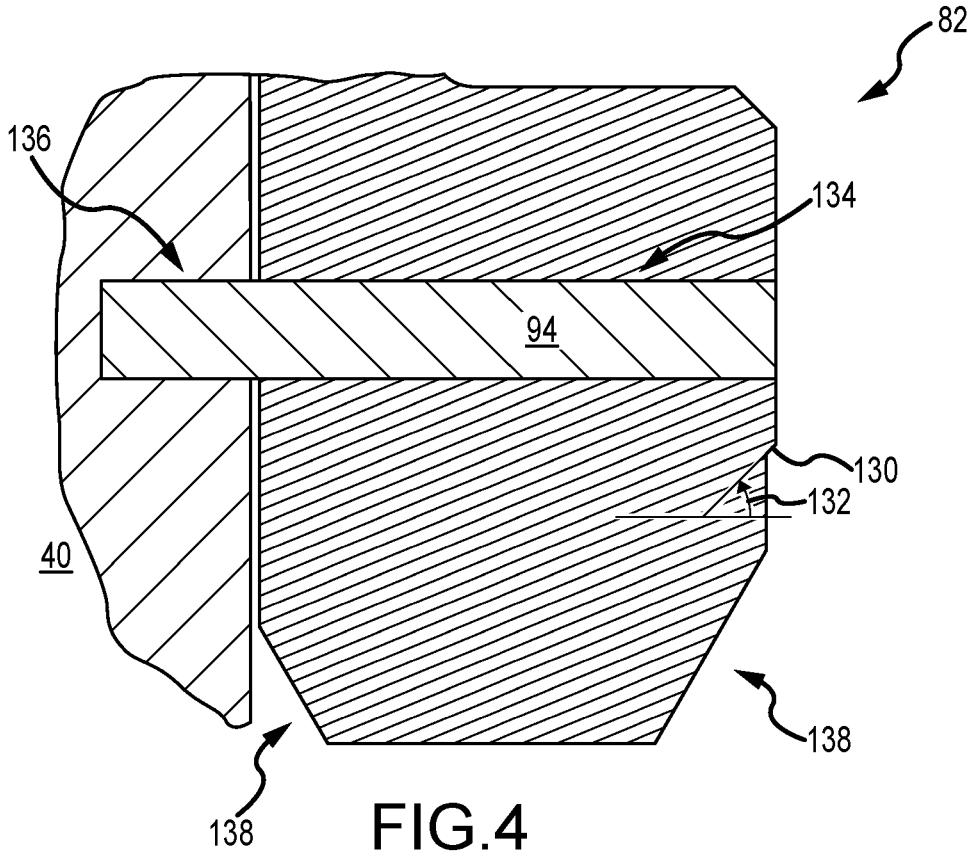
FIG. 4 is a partial detailed side view of an embodiment of an actuation ring of an expandable landing locking shoulder, in accordance with embodiments of the present disclosure.

FIG. 4 is a cross-sectional schematic side view of an embodiment of the actuation ring 82 illustrating a tag shoulder 130. In operation, as the mandrel casing hanger 40 is lowered into the wellhead 12, the tag shoulder 130 will contact a shoulder or protrusion in the wellhead 12, thereby applying a force to the actuation ring 82 that shears the shear pins 94 and drives upward movement of the actuation ring 82. In various embodiments, the size of the tag shoulder 130 is particularly selected based on the design of the wellhead 12 and/or to enable sufficient transmission of force to shear the shear pins 94. As shown, the illustrated tag shoulder 130 is arranged at an angle 132. It should be appreciated that, in other embodiments, the angle 132 may be equal to approximately 0. That is, the tag shoulder 130 may be substantially flat and/or perpendicular to the axis 64.

In the illustrated embodiment, the actuation ring 82 includes an aperture 134 for receiving the shear pin 94, which is inserted through the actuation ring 82 into a corresponding aperture 136 in the mandrel casing hanger 40. As described above, the shear pin 94 is used to hold the actuation ring 82 in a predetermined position until the tag shoulder 130 contacts the wellhead 12 and begins upward axial movement along the axis 64.

In various embodiments, the actuation ring 82 includes a variety of profiles 138, which may be referred to as landing areas. It should be appreciated that the shapes and angles of these profiles 138 may be particularly selected to reduce the weight of the actuation ring 82, to accommodate the wellhead 12 interior, and/or to distribute forces. Accordingly, the profiles 138 illustrated in FIG. 4 are for example purposes and are not intended to limit the scope of the present disclosure.

Figure 5:
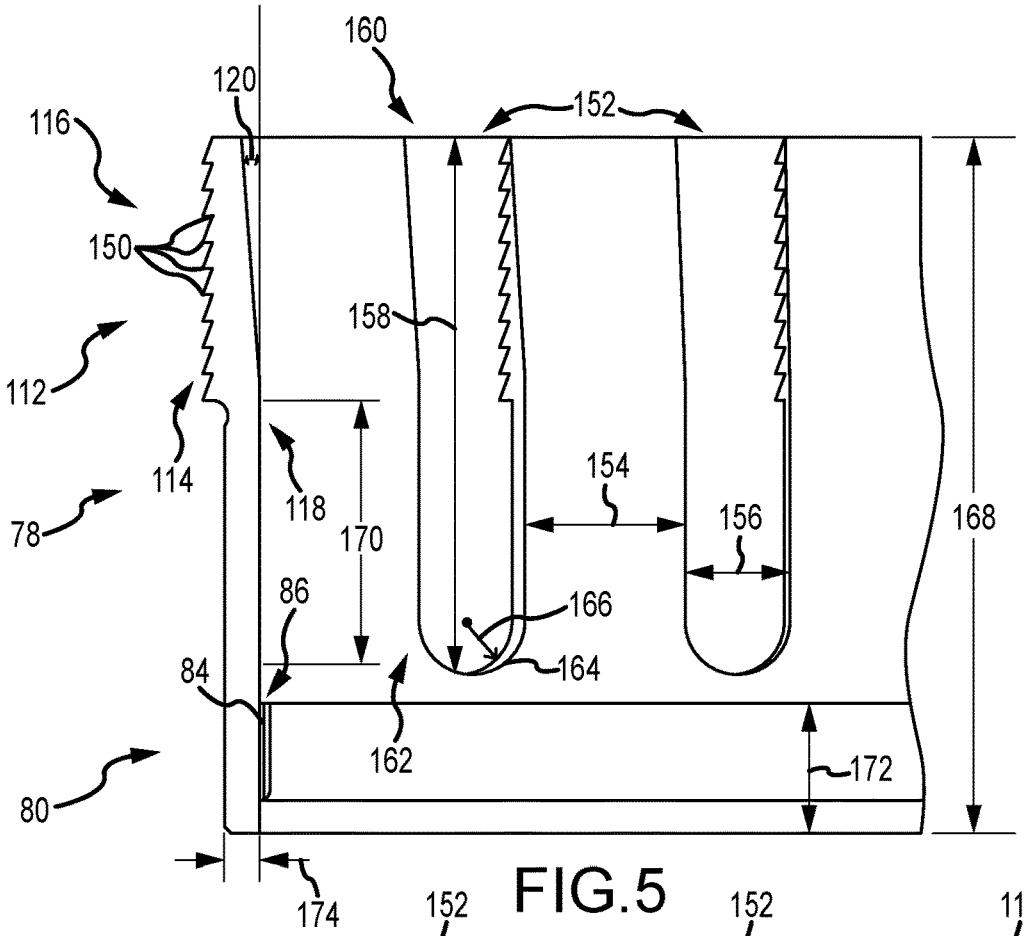
FIG. 5 is a partial detailed perspective view of an embodiment of an expandable landing locking shoulder, in accordance with embodiments of the present disclosure.

FIG. 5 is a partial detailed perspective view of an embodiment of the body portion 80 and arms 78. In the illustrated embodiment, the coupling members 84 along the interior diameter 86 are depicted as threads. However, as described above, in various embodiments other coupling members may be utilized. The arms 78 extend to the end 118 and include the head 116, which is arranged at the angle 120. The illustrated head 116 includes the landing profile 112 formed by the plurality of landing features 114, which are concentrically machined wickers in the illustrated embodiment. As described above, the landing features 114 provide a plurality of landing shoulders 150, which distribute the load acting on the expandable landing locking shoulder 76. The distribution of the load enables the expandable landing locking shoulder 76 to accommodate larger forces, for example from hanging multiple sections of casing. In various embodiments, there may be between approximately 10 and 15 different landing shoulders 150. However, 10 to 15 is provided by way of example only and any reasonable number of landing shoulders 150 may be utilized. As described above, by distributing the forces, the materials used to form the expandable landing locking shoulder 76 may be lower grade steel or the like, when compared to high nickel components, and therefore reduce costs.

As illustrated in FIG. 5, the arms 78 are spaced apart and separated by a void 152 that is machined into the body portion 80, for example via milling. The void 152 enables flexion of the arms 78, for example within the elastic range of the material, while still providing sufficient material to couple the body portion 80 to the actuation ring 82. Furthermore, the voids 152 enable circulating fluid flow during installation of the mandrel casing hanger 40. That is, as the mandrel casing hanger 40 is lowered into position, circulating fluid may flow through the voids 152 to facilitate clean out of the well. In the illustrated embodiment, the arms 78 have a first width 154 and the voids 82 have a second width 156. In various embodiments, the first width 154 is larger than the second width 156. For example, the first width 154 may be approximately 1.5 to 2 times larger than the second width 156. Furthermore, in various embodiments, the first width 154 may be approximately 1.1 times larger than the second width 156, approximately 1.2 times larger than the second width 156, approximately 1.3 times larger than the second width 156, approximately 1.4 times larger than the second width 156, approximately 1.6 times larger than the second width 156, approximately 1.7 times larger than the second width 156, approximately 1.8 times larger than the second width 156, or approximately 1.9 times larger than the second width 156. Additionally, in various embodiments, the first width 154 may be approximately 1.1 to 1.4 times larger than the second width 156, approximately 2 to 3 times larger than the second width 156, or any other reasonable range that provides sufficient flexion of the arms 78. It should be appreciated that the particular dimensions may be selected based on the anticipated or desired operating conditions.

In the illustrated embodiment, the voids 152 have a length 158 extending from a top 160 to a bottom 162 of the void 152. The illustrated bottom 162 includes a curvature 164 having a radius 166. As will be appreciated, the curvature 164 may facilitate distribution of forces as the arms 78 flex outward due to the actuation ring 82. The length 158 may be approximately 50 percent to 80 percent of the height 168 of the expandable landing locking shoulder 76. However, in various embodiments, the length 158 may be approximately 50 to 60 percent of the height 168, approximately 60 to 70 percent of the height 168, approximately 70 to 80 percent of the height 168, or any other reasonable value. It should be appreciated that, in various embodiments, the length 158 may be particularly selected based on the design conditions.

Further illustrated in FIG. 5 is a distance 170 between the bottom 162 and the head 116, which includes the landing profile 112. In the illustrated embodiment, the distance 170 is approximately half the length 158. In various embodiments, the distance 170 is approximately 25 percent of the length 158, approximately 40 percent of the length 158, approximately 50 percent of the length 158, or any other reasonable value. It should be appreciated that other distances may be included based on anticipated or desired operation conditions. For example, the distance 170 may be approximately 1 to 1.5 times a length 172 of the body portion 80. Additionally, in embodiments, the distance 170 may be approximately 0.5 times the length 172, approximately 0.75 times the length 172, or any other reasonable length. As described in detail above, various dimensions may be particularly selected based on the desired operating conditioners of the expandable landing locking shoulder 76.

In various embodiments, the arms 78 include a thickness 174. The thickness 174 may be particularly selected, as described above with respect to other dimensions, to accommodate the bore size. In various embodiments, such as the embodiment illustrated in FIG. 5, the thickness 174 is substantially equal along the longitudinal section 110. That is, the thickness 174 may be constant over the distance 170 and the length 172. However, it should be appreciated that, in other embodiments, the thickness 174 may vary, based on design conditions. For example, the thickness 174 may be larger along the length 172 to accommodate the stresses associated with coupling the expandable landing locking shoulder 76 to the actuation ring 82.

In various embodiments, the expandable landing locking shoulder 76 may be referred to as a single or unitary piece. In other words, the combination of the body portion 80 and the arms 78 may form a circumferential or annular piece without additional connectors to couple one end to another. Accordingly, the strength of the part may be improved without using stronger, more expensive materials. Furthermore, reliability may be improved because the likelihood of portions separating decreases without utilizing split or segmented components. However, it should be appreciated that, in various embodiments, the expandable landing locking shoulder 76 may be split or segmented and coupled together via a variety of fasteners.

Figure 6:
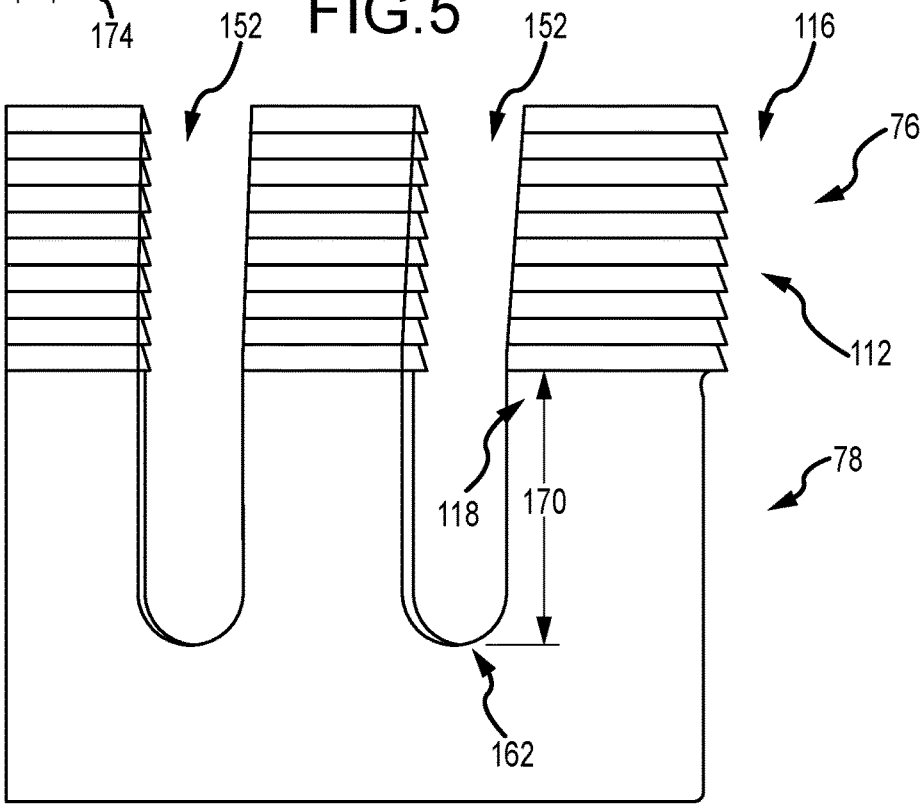
FIG. 6 is a partial detailed perspective view of an embodiment of an expandable landing locking shoulder, in accordance with embodiments of the present disclosure.

FIG. 6 is a front perspective view of an embodiment of the expandable landing locking shoulder 76 illustrating the arms 78 including the landing profile 112. It should be appreciated that the embodiment depicted in FIG. 6 may be "flat" and that the expandable landing locking shoulder 76 is substantially cylindrical such that it conforms to an outer diameter of the mandrel casing hanger 40. As described in detail above, the voids 152 are arranged between respective arms 78. It should be appreciated that any reasonable number of arms 78 may be included, with a corresponding void 152 next to the arm, and that the number may be particularly selected based on the bore size. In the illustrated embodiment, the head 116 is arranged at the end 118 of the longitudinal section 110 at approximately the distance 170 from the bottom 162. As will be appreciated, during operation, the arms 78 are driven to flex radially outward such that the head 116 and the landing profile 112 contacts a mating surface to support the mandrel casing hanger 40 for suspension of other wellbore tubulars, such as sections of casing.

FIG. 7 is a schematic cross-sectional side view of an embodiment of the mandrel casing hanger 40 arranged proximate an opening 180 of the axial bore 18 of the wellhead 12. It should be appreciated that while the illustrated embodiment includes the wellhead 12 and may be described with reference to running tools that the expandable landing locking shoulder 76 may be used in a wide variety of applications. For example, embodiments of the present disclosure may be utilized with surface wellhead equipment, mudline suspension equipment, offshore applications, subsea completion systems, and the like. In the illustrated embodiment, the mandrel casing hanger 40 may be lowered via a running tool, which is not pictured for clarity. As illustrated, the bore 18 and the bore 42 are substantially aligned along the axis 64. The bore diameter 26 is larger than or substantially equal to the diameter 66, thereby enabling installation of the mandrel casing hanger 40 to compress the seal 72 against the wellhead 12. It should be noted that the expandable locking shoulders are "collapsed" making the passage through a conduit prior to landing more efficient. As a result, fluid flow, which may be enabled through the voids 152 as described above, may be blocked by the seal 72.

The illustrated wellhead 12 does not include a notch 24 for the load ring 16, such as the wellhead 12 illustrated in FIG. 1, because the inclusion of the expandable landing locking shoulder 76 eliminates the need of the load ring 16, thereby overcoming the various problems identified above. The wellhead 12 depicted in FIG. 7 includes a recess 182, which may be machined and include one or more corresponding wickers or the like, for contact with the landing profile 12 when the mandrel casing hanger 40 is installed. Furthermore, an activation shoulder 184 is positioned downhole of the recess 182. As described above, the activation shoulder 184 may contact the tag shoulder 130 to drive upward axial movement of the actuation ring 82.

Prior to installation, the mandrel casing hanger 40 is evaluated to determine the position of the actuation ring 82. For example, the shear pins 94 may be installed to hold the actuation ring 82 in a predetermined position prior to installation within the wellhead 12. As described above, the position of the actuation ring 82 may, at least in part, influence the position of the expandable landing locking shoulder 76. Accordingly, if the expandable landing locking shoulder 76 is in an undesired position, such as a position where the outer diameter is greater than the diameter 66, the mandrel casing hanger 40 may not fit within the axial bore 18.

FIG. 8 is a schematic cross sectional view of an embodiment of the mandrel casing hanger 40 partially positioned within the axial bore 18. In the illustrated embodiment, the seal 72 is positioned within the bore 18, however, is not fully compressed to facilitate flow back through the voids 152 formed in the expandable landing locking shoulder 76. Accordingly, well clean out and the like may continue even though the mandrel casing hanger 40 is being installed within the well. Upon installation, the tag shoulder 130 contacts the activation shoulder 184, which generates a force due to the weight of the mandrel casing hanger 40, among other potential downward forces, such as one applied by the running tool, to drive the actuation ring 82 in an upward axial direction along the axis 64.

In the embodiment illustrated in FIG. 8, the distance 98 between the stop shoulder 100 and the extension 102 has decreased compared to FIG. 7, indicating the upward movement of the actuation ring 82. As a result, the expandable landing locking shoulder 76 also moves upward due to the connection via the respective coupling members 84, 88. As illustrated, the head 116 of the arms 78 moves along the tapered shoulder 60 and the arms 78 begin to flex radially outward, as indicated by the arrows 186. However, it should be appreciated that the mandrel casing hanger 40 will continue to move downward, as illustrated in FIG. 9, to set the expandable landing locking shoulder 76.

FIG. 9 is a schematic cross-sectional side view of an embodiment of the mandrel casing hanger 40 secured to the wellhead 12 via the expandable landing locking shoulder 76. In the illustrated embodiment, the seal 72 is pressed against the axial bore 18 to thereby block fluid flow upward through the bore 18. Furthermore, as shown, the landing profile 112 is arranged within the recess 182. The plurality of landing features 114 forming the landing shoulders 150 may align with mating shoulders or recesses, or in other embodiments, with a substantially smooth machined bore, and apply and outward force to the recess 182 to block downward axial movement of the mandrel casing hanger 40. Further illustrated is the extension 102 in contact with the stop shoulder 100, thereby blocking further upward movement of the actuation ring 82. As a result, the mandrel casing hanger 40 is secured within the wellhead 12, where it may receive a wellbore tubular, such as a casing string, to facilitate additional downhole activities. As described above, due to the compact nature of the design of the expandable landing locking shoulder 76 (e.g., the arrangement where the arms 78 are stored within the outer diameter 66 of the mandrel casing hanger 40 during installation), larger diameter casings may be utilized, as well as longer casing strings. Larger diameters facilitate larger flow rates, which may be useful for greater production or improved flow within the wellbore for cleaning and circulating purposes. Additionally, the drawbacks associated with the use of the load rings have been eliminated, which may produce a more reliable and less costly hanging solution.

Figure 10:
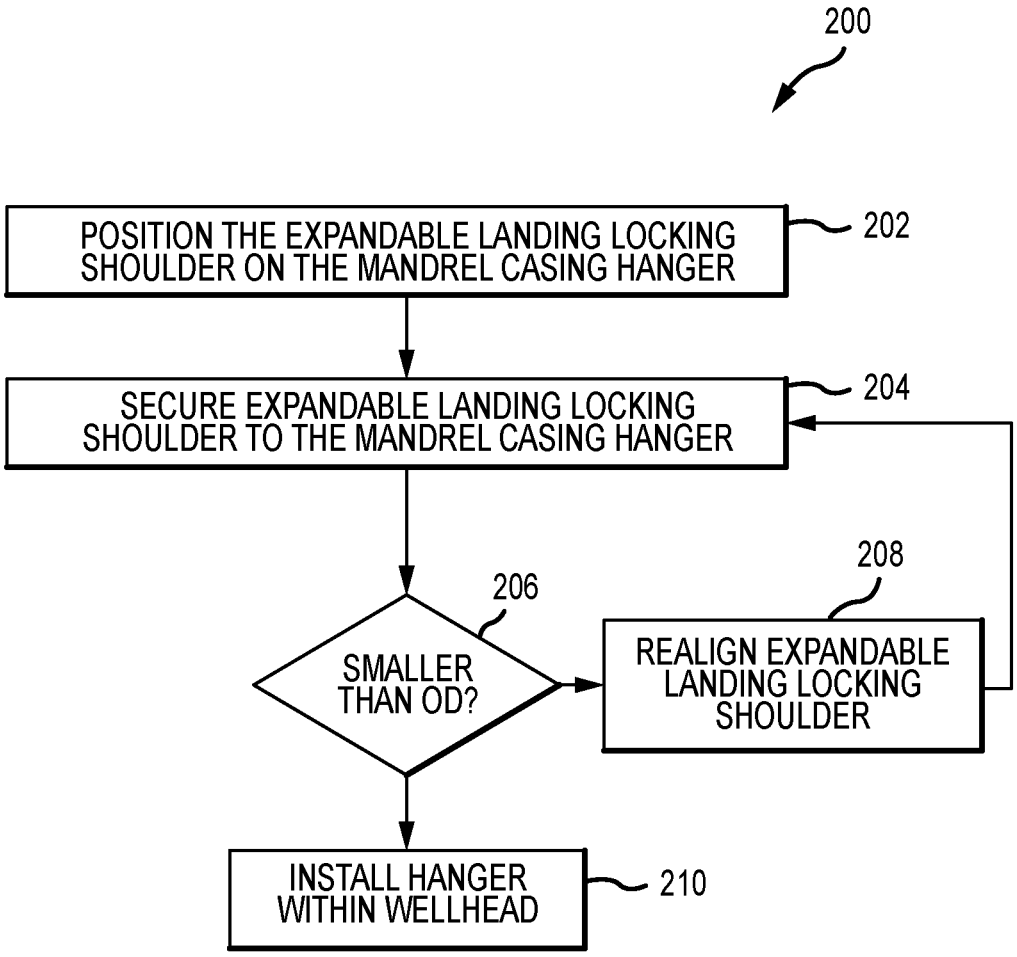
FIG. 10 is a flow chart of an embodiment of a method for installing a mandrel casing hanger in a wellhead, in accordance with embodiments of the present disclosure.

FIG. 10 is a flow chart of a method 200 for installing the mandrel casing hanger 40 within the wellhead 12. It should be appreciated that the method 200 may include fewer or more steps and in various embodiments the steps may be performed in a different order or in parallel unless otherwise explicitly stated. In various embodiments, the expandable landing locking shoulder 76 is positioned on the mandrel casing hanger (block 202). For example, the expandable landing locking shoulder 76 may be coupled to the actuation ring 82, for example via the body portion 80. Furthermore, in various embodiments, positioning may also include aligning the apertures 134, 136 to place the actuation ring 82 at a predetermined position. The expandable landing locking shoulder 76 may be secured to the mandrel casing hanger 40 (block 204). For example, shear pins 94 may be installed within the apertures 134, 136 to thereby hold the actuation ring 82 in position. Thereafter, in the illustrated embodiment, the outer diameter of the expandable landing locking shoulder 76 is compared to the outer diameter 66 of the mandrel casing hanger 40 (block 206). For instance, an operator may visually inspect whether the diameter 66 is greater than an outer diameter of the expandable landing locking shoulder 76. If not, the expandable landing locking shoulder may be realigned (block 208). If the diameter is smaller, then the mandrel casing hanger may be installed within the wellhead 12 (block 210). In various embodiments, installation may include utilizing a running tool to lower the mandrel casing hanger 40 into the wellhead 12. Furthermore, installation may also include engaging the tag shoulder 130 with the activation shoulder 184 to thereby drive the actuation ring 82 in the upward axial direction to drive the arms 78 radially outward to secure the mandrel casing hanger 40 within the wellhead 12.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A system for supporting a wellbore tubular within a wellbore, the system comprising:

a wellbore component associated with the wellbore, the wellbore component comprising an axial bore arranged along an axis;

a hanger installed within the wellbore component to support the wellbore tubular, the hanger comprising a shoulder that receives the wellbore tubular and suspends the wellbore tubular along the axis; and an expandable landing locking shoulder arranged circumferentially about the hanger, the expandable landing locking shoulder comprising:

an actuation ring removably coupled to a body of the hanger, the actuation ring comprising a shoulder and an extension, the extension extending longitudinally in an upward direction from the shoulder;

a body portion coupled to, and at least partially radially overlapping, the actuation ring, the body portion comprising coupling members that mate with corresponding coupling members of the actuation ring; and arms extending in the upward direction from the body portion, the arms comprising a head with a landing profile that engage a recess formed in the wellbore component when in an activated position.

2. The system of claim 1, further comprising:

an activation shoulder formed in the wellbore component, the activation shoulder protruding radially into the axial bore; and a tag shoulder formed on the actuation ring, wherein the tag shoulder contacts the activation shoulder when the hanger is installed within the wellbore component, the tag shoulder transmitting an upward force from the activation shoulder to drive the actuation ring longitudinally uphole along the axis to transition the expandable landing locking shoulder from a deactivated position to the activated position.

3. The system of claim 1, further comprising:

voids positioned between adjacent arms of the expandable landing locking shoulder, the voids separating the arms to enable outward radial flexion of the arms, wherein the voids form a flow path between the hanger and the axial bore to enable flow by during installation of the hanger.

4. The system of claim 1, further comprising:

a shear pin extending through the actuation ring, the shear pin coupling the actuation ring to the hanger via respective apertures formed in the actuation ring and the hanger, wherein the shear pin holds the actuation ring in a predetermined position until the actuation ring is transitioned to the activated position.

5. The system of claim 1, further comprising:

a seal circumferentially about an upper portion of the hanger, the seal forming a fluid barrier between the hanger and the axial bore when the hanger is in the activated position.

6. The system of claim 1, further comprising:

a tapered shoulder extending along the hanger, the tapered shoulder having a downward angle that extends from an outer diameter of a first portion of the hanger toward the axis, wherein at least the head of the expandable landing locking shoulder is driven radially outward via the tapered shoulder as the actuation ring moves upward along the axis toward the activated position.

7. The system of claim 1, further comprising:

a stop shoulder formed on the hanger, the stop shoulder blocking upward movement of the actuation ring via contact with the extension, the stop shoulder limiting upward axial movement of the actuation ring beyond the activation position.

8. The system of claim 1, wherein the landing profile comprises a plurality of landing shoulders, the landing shoulders extending into the recess and engaging the wellbore component to secure the hanger within the wellbore component.

9. A system for suspending a hanger within a wellbore component, the system comprising:

an actuation ring circumferentially positioned about the hanger, the actuation ring having a substantially annular shape;

one or more arms removably coupled to the actuation ring, the one or more arms extending longitudinally from the actuation ring, being positioned radially outward from at least a portion of the actuation ring, arranged along at least a portion of a sloped surface of the hanger, and comprising a head at an end opposite the actuation ring;

a landing profile formed on the head on an outer diameter of the head, the landing profile comprising a plurality of landing features forming a plurality of landing shoulders, each landing shoulder of the plurality of landing shoulders being arranged radially outward from the actuation ring while in a stored position; and a tag shoulder formed on the actuation ring, the tag shoulder arranged to contact a protrusion within the wellbore component to drive upward axial movement of the actuation ring along an axis, the upward axial movement being transferred to the one or more arms to move the one or more arms toward an activated position.

10. The system of claim 9, wherein the hanger comprises a tapered shoulder and the head is arranged along the tapered shoulder, the head being driven along the tapered shoulder via movement of the actuation ring to drive the head radially outward from the axis.

11. The system of claim 9, wherein the one or more arms comprises a plurality of arms, the system further comprising:

a void arranged between adjacent arms of the plurality of arms, the void having a width less than an arm width and a curvature at a bottom thereof, the void forming a flow path for circulating fluid.

12. The system of claim 11, wherein a length of the void is greater than a length of the head, the void extending from a top of the one or more arms to a body portion that couples the one or more arms to the actuation ring.

13. The system of claim 9, wherein the hanger comprises a stop shoulder, the system further comprising:

a gap formed between an extension extending longitudinally from the actuation ring and the stop shoulder, the gap defining a distance of movement of the actuation ring along the hanger.

14. The system of claim 9, further comprising:

an aperture formed through the actuation ring, the aperture receiving a shear pin to couple the actuation ring to the hanger at a predetermined position.

15. The system of claim 9, wherein the one or more arms are formed from a metal, a plastic, a composite material, or a combination thereof.

16. The system of claim 9, wherein the one or more arms are maintained below a plastic deformation zone when in the activated position.

17. A method for installing a hanger within a wellbore component, the method comprising:

coupling an arm to an activation ring along a lower region of the arm and along an extension of the activation ring;

coupling an expandable landing locking shoulder, including the arm and the activation ring, to a mandrel hanger, the expandable landing locking shoulder circumferentially surrounding the mandrel hanger, at least a portion of the arm of the expandable landing locking shoulder positioned radially outward from the activation ring;

determining if an outer diameter of the mandrel hanger is greater than an outer diameter of the expandable landing locking shoulder; and installing the mandrel hanger within the wellbore component when the outer diameter of the mandrel hanger is greater than the outer diameter of the expandable landing locking shoulder.

18. The method of claim 17, further comprising:

engaging a protrusion within the wellbore component with a tag shoulder of the expandable landing locking shoulder; and driving arms of the expandable landing locking shoulder radially outward from the mandrel hanger to engage a recess formed in the wellbore component.

19. The method of claim 17, further comprising:

positioning a head of the expandable landing locking shoulder along a tapered shoulder of the mandrel hanger; and driving movement of the head along the tapered shoulder, the tapered shoulder driving the head radially outward from the mandrel hanger and flexing at least a portion of the expandable landing locking shoulder.

20. The method of claim 17, further comprising:

removing the expandable landing locking shoulder when the outer diameter of the mandrel hanger is less than the outer diameter of the expandable landing locking shoulder; and repositioning the expandable landing locking shoulder on the mandrel hanger.

* * * * *